United States Patent [19]

Davenport et al.

[11] Patent Number: 5,045,045

[45] **Date of Patent: * Sep. 3, 1991**

[54] SKIP-SCORER, SKIP-PERFORATOR FOR USE WITH PRINTING PRESS SYSTEMS

[75] Inventors: Harold D. Davenport, La Mirada; Anthony J. Devito, Huntington Beach, both of Calif.

[73] Assignee: D & D Enterprises, Orange, Calif.

[ * ] Notice: The portion of the term of this patent subsequent to Jun. 25, 2002 has been disclaimed.

[21] Appl. No.: 493,721

[22] Filed: Mar. 15, 1990

[51] Int. Cl.[5] ..... B26D 3/08

[52] U.S. Cl. ..... 493/363; 83/332; 83/347; 83/659; 83/660; 83/863; 83/884; 493/370; 493/402; 493/471

[58] Field of Search ..... 493/363, 370, 402, 471; 83/346, 347, 505, 509, 510, 511, 512, 659, 660, 863, 884, 885, 886, 301, 302, 332; 270/20.1, 21.1

[56] References Cited

U.S. PATENT DOCUMENTS 3,200,687 8/1965 Paulson ..... 83/505 X 3,522,754 8/1970 Sauer ..... 83/347 X 4,524,962 6/1985 Davenport et al. ..... 270/21.1

*Primary Examiner*—Frank T. Yost

*Assistant Examiner*—Kenneth E. Peterson

*Attorney, Agent, or Firm*—G. Donald Weber, Jr.

[57] ABSTRACT

A web scoring and/or perforating apparatus for signature folding machines or the like including first and second rollers. Each roller has a scoring or perforating blade portion and a resilient roller portion. The rollers are mounted, preferably, on existing, rotatably driven nip roller shafts, upstream of web folding stages in web handling systems. The blade portion of one roller is arranged to interact with the resilient portion of the other roller. Arc lengths of the scoring or perforating roller blade portions and the resilient roller portions are substantially equal to each other and to the fold line of a signature. The rollers, between which the web is advanced, are positioned and oriented to score or perforate portions of the web in alternating directions which correspond to the direction of folding of each layer of the web.

14 Claims, 1 Drawing Sheet

FIG. 1
(PRIOR ART)
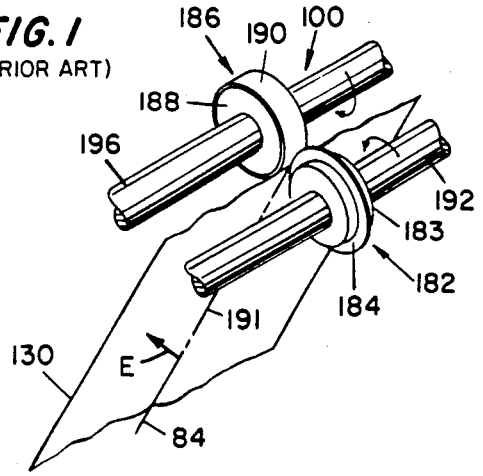
FIG. 2
(PRIOR ART)
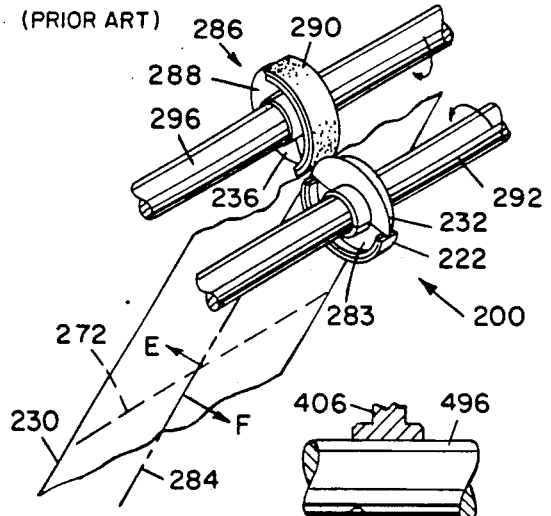
FIG. 3
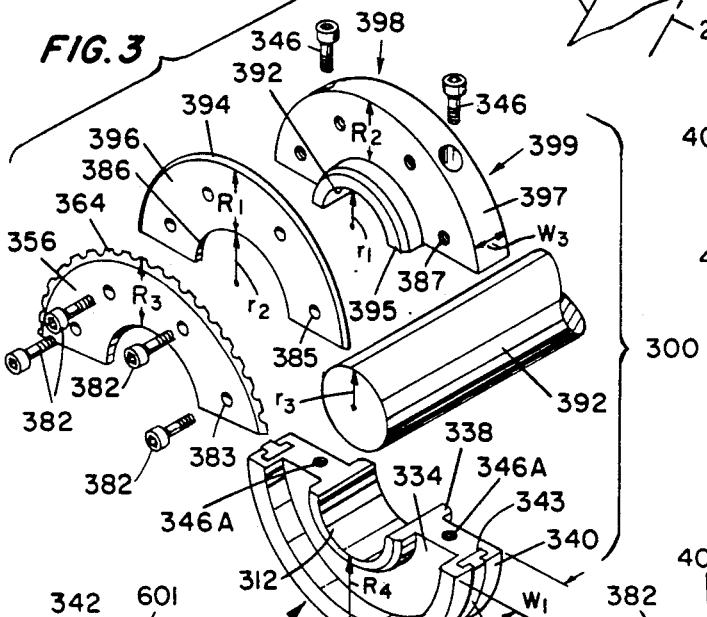
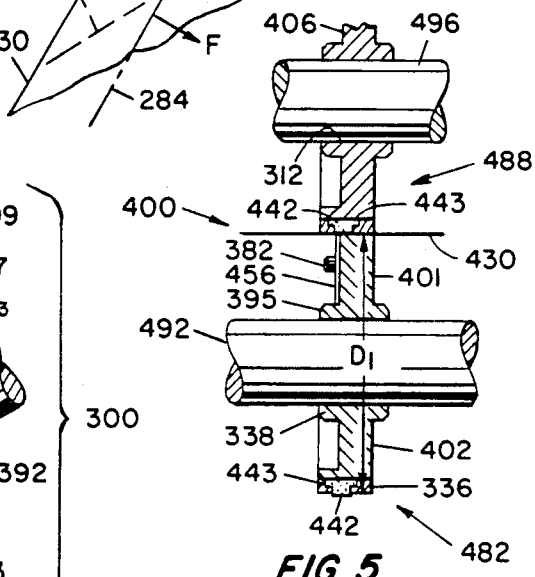
FIG. 5
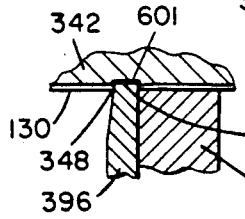
FIG. 6
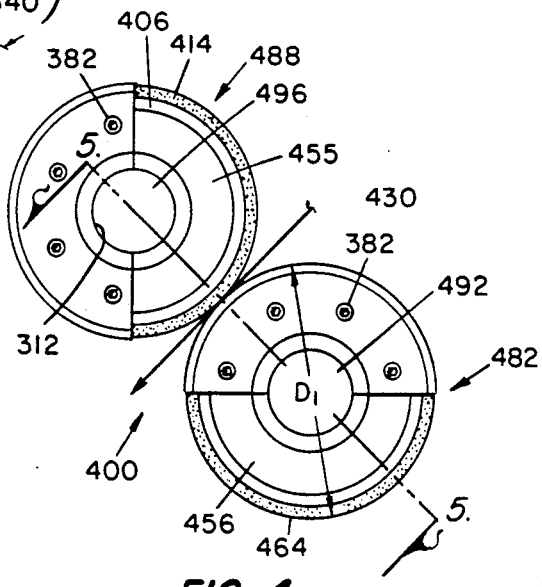
FIG. 4
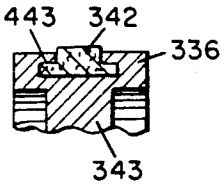
FIG. 7
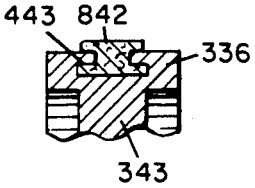
FIG. 8

SKIP-SCORER, SKIP-PERFORATOR FOR USE WITH PRINTING PRESS SYSTEMS

BACKGROUND

1. Field of the Invention

The present invention relates, generally, to the field of printing press apparatus and, more particularly, to paper perforating and scoring devices directly associated with continuous web printing presses.

2. Prior Art

Expensive, high speed printing presses are commonly used by commercial printing companies. Many such printing presses are fed from large rolls of paper on a continuous strip of paper known in the art as a "web". The presses are generally known in the industry as web presses and may cost between two and three million dollars each.

A web press, typically, requires the use of an automated web cutting and folding machine to receive the printed web at high velocity. The cutting and folding machine automatically cuts the web into sheets and folds the sheets one or more times into folded articles referred to as "signatures". The signatures may be sold as produced or they may be delivered to other machines which stitch or bind the signatures into books, booklets, magazines, or the like. Such signature folding machines are very expensive.

Consequently, it can be appreciated that the presses and folding machines must be capable of operating for extended periods of time at very high speeds in order to be cost effective in the production of finished signatures. However, problems which significantly limit folder and, hence, press speed are commonly associated with the signature folder operation.

One of the significant problems is that many commonly used signature folders are constructed to perform two or more sequential paper folding operations. In a first folding operation, the web is inserted along a fold line between rollers which make the fold and cut the web. The folding problems associated with the first folding stage are no greater than might be expected in high speed folding operations inasmuch as the web is still intact and taut when the first fold is made. However, any subsequent fold is, generally, accomplished by a blade striking the already folded, and severed, sheet along a second fold line and pushing the new fold between a second (and subsequent) pair of rollers. This folding process can be repeated several times.

One way to overcome the problems associated with signature folders is to use two separate signature folders, each of which is operated at half the press speed. Although signature production rates can be substantially increased, equipment and overhead costs are also increased significantly.

Recognizing the above, press and folder manufacturers have attempted to reduce the second stage folding problems by scoring the web along the second fold line before the first fold is made. For such pre-fold scoring, the web passes through a web scoring apparatus in the signature folder upstream of the first folding stage. The scoring apparatus typically includes a circular scoring blade mounted on one side of the web and a resilient roller mounted on the other side of the web. As the web advances between the rotating scoring blade and roller, a longitudinal indentation or groove is pressed by the blade into the web along the subsequent second fold line. However it has been found that the longitudinal pre-fold scoring of the web does not significantly reduce second stage folding problems and may actually increase same. That is, uniform, pre-fold web scoring scores only part of the sheet in the correct direction for second stage folding. The other part of the sheet is actually scored in the wrong direction for the second fold.

For these and other reasons, a pre-fold web scoring apparatus for use in signature folders and which scores the web in alternating directions corresponding to the second fold direction for each layer of the paper is desirable. Such a device is referred to as a "skip-scorer" and is described in U.S. Pat. No 4,524,962.

The skip-scorer of the prior art includes a pre-fold scoring apparatus through which paper is fed prior to being folded into signatures. The scoring means includes first and second rollers each having separate scoring and resilient abutment portions configured for causing prescribed lengths of the paper to be scored in alternating directions thereby to facilitate the folding thereof. The scoring means are mounted in the path of paper travel so as to enable scoring of the paper before the paper enters the first folding stage.

Preferably, the scoring means comprise first and second complementary-shaped scoring rollers, each of which has alternating peripheral scoring blades and resilient roller portions having arc lengths equal to the length of the fold. The first and second scoring rollers are rotatably mounted upstream of the first folding stage and in the path of paper travel. The two scoring rollers are mounted in mutual, peripheral rolling contact so that the scoring blade portion of each contacts the resilient roller portion of the other as the scoring rollers are rotated. Portions of the paper passing between the scoring rollers is thereby scored in one direction and other portions of the paper are scored in the opposite direction so that each layer of paper to be folded in multiple folding stages is scored in the correct folding direction.

To enable proper scoring for different weights of paper, the scoring blade portions of the first and second scoring rollers are constructed so that each comprises a scoring blade having an arcuate scoring edge which bears upon the resilient roller portion. However, this operation tends to cause the resilient portion of the rollers to wear down. When the resilient portions wear down, the scoring does not occur accurately. Thus, it is necessary to replace the resilient portion of the roller. This replacement is time consuming and expensive in that the roller must be removed from the press and a new roller inserted. Replacement of the resilient surface pads on a roller is, generally, not satisfactory wherein the entire unit must be replaced. Consequently, a more economical arrangement for scoring and/or perforating is desirable.

PRIOR ART STATEMENT

The most pertinent prior known to Applicants is listed herewith in numerical order with no significance intended to the ordering.

U.S. Pat. No. 1,196,912; ADJUSTABLE CREASING OR SCORING MECHANISM; E. E. Weck. This patent is directed to a self-contained mechanism capable of scoring a paper along parallel lines spaced apart by any distance.

U.S. Pat. No. 1,525,238; SLOTTING AND SCORING DEVICE; N. L. Hurd. This patent is directed to an apparatus for slotting and scoring box-board materials with a pair of slotting blades spaced apart by a prescribed distance.

U.S Pat. No. 1,839,491; SCORING MECHANISM FOR ENVELOPE MACHINES AND THE LIKE; A. Novick. This patent is directed to a mechanism for scoring envelope blanks preparatory to folding the blanks into a finished envelope.

U.S. Pat. No. 3,198,092; SCORE MOISTENING DEVICE; H. F. Koran. This patent is directed to an attachment for sheet folding systems which moistens the surface of one or more scoring rollers so that the sheets may be moistened in the areas of the scores thereby producing more effective and more accurate folding of the sheets.

U.S. Pat. No. 3,917,254; APPARATUS FOR FOLDING OF A WEB; H. N. Watrous. This patent is directed to an apparatus which includes a pair of cooperating rollers which roll along fold lines of web in order to loosen the bonds in the web transverse to the ultimate fold lines thereby facilitating folding.

U.S. Pat. No. 3,949,654; ASSEMBLY FOR USE IN A MACHINE FOR PROCESSING SHEET OR SIMILAR MATERIAL; H. Stehlin. This patent is directed to an assembly for processing of sheet material wherein a rotatable tool and an opposing part are positionally adjustable to various spacing therebetween and include toothed shafts which operate as feed rollers for feeding sheet material to the apparatus.

U.S. Pat. No. 4,014,535; CONTINUOUS SHEET COLLATING METHOD AND APPARATUS; R. E. Kleid et al. This patent is directed to a continuous sheet collating system.

U.S. Pat. No. 4,046,366; METHOD FOR PRODUCING BOOKS; W. B. McCain, et al. This patent is directed to a method for producing books by juxtaposing webs of printed material obtained from rolls which are cut, folded twice and delivered to a saddle conveyor for trimming.

U.S. Pat. No. 4,416,652; UNIT FOR SCORING WEBS OF PAPER IN THE LENGTHWAYS DIRECTION; R. Fischer, et al. This patent is directed to an apparatus which includes a folder blade for producing a lengthways fold relative in a web of paper.

U.S. Pat. No. 4,524,962; PRE-FOLD, WEB SCORING APPARATUS FOR SIGNATURE FOLDING MACHINE; H. D. Davenport et al. This patent is directed to a printing system which includes a scoring means for applying a pre-fold score in alternating directions along a longitudinal line in the paper to be scored.

SUMMARY OF THE INSTANT INVENTION

According to the present invention, an improved pre-fold scoring and/or perforating apparatus is provided for a machine through which a web, e.g. printed paper, is fed for folding, for example, into signatures and provides a so-called "perfect" binding. The scoring or perforating means include first and second rollers each having separate scoring or perforating portions and resilient abutment portions. The rollers are configured to cause the web to be scored or perforated in alternating directions and for a prescribed length thereby to facilitate the folding thereof. Alternatively, the apparatus can score in one direction with perforated lines intermediate (and co-linear with) the score lines.

Preferably, the improved scoring apparatus comprises first and second scoring rollers, each of which has, alternatively, a peripheral scoring blade or a peripheral perforating blade in conjunction with resilient roller portions. The blades and the resilient rollers have arc lengths equal to the length of the fold or perforation to be made. The rollers are mounted in the system upstream from the folding stage and in the path of the paper travel.

The two scoring rollers are mounted in mutual, peripheral rolling contact so that the scoring or perforating blade portion of each roller contacts the resilient portion of the other roller as the scoring rollers are rotated. Portions of the paper passing between the scoring rollers are thereby scored in one direction and other portions of the paper are scored in the opposite direction. Alternatively, portions of the paper are perforated by the perforation blade so that each layer of paper is scored or perforated in the correct direction.

The scoring rollers are split in half across a diameter and include means for clamping the two halves together around the respective mounting shaft. As a result of such construction, the lateral and rotational position of the scoring rollers on the shafts can be quickly and easily adjusted to align the scoring blades with the fold line of the paper.

To enable desired scoring or perforating, the scoring or perforating blades of the first and second rollers are constructed so that each comprises a blade edge having an arcuate scoring or perforating edge. The blade is detachably fixed to the associated scoring roller to enable easy and rapid replacement of the blades without dismounting the scoring rollers from the mounting shafts. The scoring blades are mounted about mid-width of the resilient roller portion of the same roller.

The resilient roller portion includes a relatively narrow strip or pad of resilient material, such as urethane. This pad is inserted into and interlockingly engages a slot or groove in the peripheral surface of the resilient roller. The pad is easily moved into and out of the slot for simple replacement.

This prefold web scoring apparatus may, accordingly, modify existing signature folding machines.

BRIEF DESCRIPTION OF THE DRAWINGS

FIG. 1 is a pictorial diagram illustrating a continuous pre-fold scoring apparatus known in the prior art.

FIG. 2 is a pictorial diagram illustrating an alternating pre-fold scoring apparatus known in the prior art.

FIG. 3 is an exploded isometric drawing of an operational roller of the instant invention showing construction features thereof including alternative scoring and perforating blades.

FIG. 4 is an end view of operating rollers of the instant invention mounted on pre-existing nip roller shafts.

FIG. 5 is a cross-sectional view of the apparatus of the instant invention taken along line 5—5 of FIG. 4.

FIG. 6 is an oversize drawing showing the engagement of a portion of one of the operating rollers of the instant invention with the paper passing between the blade portion and the resilient roller portion of the opposing roller.

FIGS. 7 and 8 are partial, broken away, sectional views of alternative designs of the resilient portions of the rollers of the instant invention.

DESCRIPTION OF THE PREFERRED EMBODIMENT

The present invention, relates to an improved apparatus for selectively perforating or scoring paper in a signature folding machine prior to the folding of the paper. The improvement of this invention provides more economical utilization of the press machinery.

FIGS. 1 and 2 are schematic representations of prior art devices. In particular, FIG. 1 shows a scoring apparatus 100 known in the prior art including exemplary, preexisting scoring rollers 182 and 186 mounted on shafts 192 and 196, respectively. Roller 182 includes circular hub 183 with a 360° circular scoring blade 184 extending radially outwardly from the periphery thereof. Likewise, corresponding roller 186 comprises a circular disk 188 having a 360° peripheral resilient pad 190 attached thereto. Thus, as web 130 (which can be an elongated strip of paper) advances between rotating rollers 182 and 186, blade 184 makes a continuous, unidirectional score line 191 along web fold line 84. That is, the blade 184 bears on the web 130 and presses same into the resilient pad 190 to form a score-line crease.

The score line 191 is, as shown, unidirectional through the web (as indicated by arrow "E"). As a result, when web 30 is cut and folded transversely in a first folding stage (not shown), an upper paper layer tends to be arched upward in its scoring direction "E" while a lower paper layer tends to be arched downward in its scoring direction "E" (or vice versa). Therefore, when the folded sheet is fed into a second operating stage (not shown) the two paper layers tend to move or slide relative to one another, causing folding (and other) misregistration.

Moreover, in this apparatus, blade 184 can be integrally formed with the disk 183 (or hub) portion of roller 182. Also, the resilient pad 190 is mounted to the disk 188 (or hub) portion of roller 186. Typically, the pad 190 is glued to the hub wherein the entire pad 190 must be removed and replaced when the circumferential portion thereof which engages the blade 184 becomes sufficiently worn that the score line in the paper is ineffective. This replacement is costly, as noted above.

Referring to FIG. 2, there is shown an improved web scoring apparatus 200 which is known in the prior art. This apparatus is configured to cause alternate direction (or bidirectional) scoring of web 230 along web line 284 before the web enters a folding stage (not shown). In particular, scoring rollers 282 and 286 are mounted on shafts 292 and 296, respectively, of prior art scoring apparatus 200. Roller 282 includes a peripheral pad 222 which is affixed to 180° of the circumference thereof. The other 180° portion of the periphery of roller 282 includes the radially extending blade 232. The blade 232 and the pad 222 are affixed to a hub or disk 283. Roller 286 is similarly constructed with a 180° peripheral pad 290 and a 180° peripheral blade 236 on a hub or disk 288. The blades 232 and 236 are arranged to bear against the pads 290 and 222, respectively, and to cause one half of the score line 284 for each sheet 230 to be in one direction (see arrow "E") and the other half of the score line to be in the opposite direction (see arrow "F"). Thus, when sheet 230 is transversely folded, for example at fold line 272, the score lines 284 of both layers arch in the same direction and nest together at the score line.

Because both layers of paper and the respective score lines are nested together, there is virtually no tendency for layers to slip relative to one another. Thus, signatures are properly folded even at very high production rates.

The resilient pads 222 and 290 are affixed to the outer peripheral surfaces of the respective support hub or disk 283 or 288. When a pad is worn, it must be replaced. Typically, the entire roller unit must be removed and replaced at significant cost, including down time of the press equipment.

Referring now to FIG. 3, there is shown an exploded view of the improved scoring and/or perforating device 300 of the instant invention. The device 300 represents one roller unit. Obviously, a pair (or more) of such devices are used with a scoring unit. Each scoring device 300 includes the scorer/perforator portion 399 and the resilient roller portion 307.

The scorer/perforator portion 399 includes a relatively sturdy, semicircular blade support element or hub 398. A relatively thin, semicircular scoring blade 396 and a relatively thin semicircular perforating blade 356 are shown adjacent to the hub 398. One or the other of the blades 396 or 356 is used alternatively depending upon the operation to be performed. Blade support element 398 has a semicircular, radial fan-shaped section 397 with a radius $R_2$ measured to the outer periphery thereof. A semicircular flange 395 extends axially from support 397. The flange 395 has an inner radius $r_1$ and an outer radius $r_2$ and defines half of a central mounting aperture 392.

Scoring blade 396 has a tapered, semicircular web-scoring edge 394 around the outer periphery thereof. A concave semicircular cutout 386 has an inner radius of approximately $r_2$. This configuration enables the blade 396 to fit closely over the outer surface of flange 395. The outer radius $R_1$ of blade 396 at edge 394 is slightly greater than the outer radius $R_2$ of the outer peripheral surface of blade support element 398. Typically, the difference between the $R_1$ and $R_2$ dimensions is between about 0.002 inches and about 0.008 inches with a preferred value of about 0.005 inches.

Perforating blade 356 is substantially identical in construction to scoring blade 396 except that the outer peripheral edge 364 thereof is toothed so as to pierce portions of the web 130. Typically, perforator blade 356 has an outer radius $R_3$ wherein the teeth 364 extend about 0.003 inches beyond the periphery of support 398.

Four bolts 382 detachably pass through four associated apertures 383 and 385 in blades 396 or 356, respectively. The bolts are threadedly attached to support element 398 via the tapped holes 387. Bolts 382 enable easy attachment and removal of a blade. Thus, exchanging different blades for use with different thickness of web 130, without otherwise disassembling or removing apparatus 300 from the folding machine, is readily accomplished.

The resilient roller portion 307 of scoring roller 300 is formed of a rigid, radial support section 334 similar to support element 398. Roller 301 has a semicircular outer peripheral flange 336 and a semicircular inner flange 338 (similar to flange 395 of element 398). The inner flange defines the other half of mounting aperture 312 with radius $r_2$.

Mounted at the outer surface 340 of outer flange 336 is a resilient strip 342. Strip 342 is, essentially, a T-shaped pad formed of a tough but resilient material such as urethane. The wider end or cross-bar portion of pad 342 is secured in a blind slot 343 formed in the outer periphery of flange 336 of roller portion 301. The exposed "foot" of the resilient strip 342 has a width $W_2$ which is, typically, less than half the width $W_1$ of outer flange 336. The strip 342 has a total depth of about $\frac{1}{4}$ inch. The total radius $R_4$ of roller portion 301 to the outer surface of resilient strip 342 is substantially equal to the radius $R_2$ of support element 398. Consequently, the edge radius $R_1$ of blade 396 (or radius $R_3$ of blade 356) is greater than the radius $R_4$ and causes (or permits) paper scoring (or perforating) as described below. Peripheral width $W_1$ of outer flange 336 of roller portion 307 is, preferably, about twice the width $W_3$ of radial support element 398. Thus, when blade portion 399 and roller portion 301 are assembled together by bolts 346 to form scoring roller 300, the edge of blade 396 (or blade 356) is located at about mid-width of resilient strip 342.

To enable secure mounting of scoring roller 300 to shaft 392, the inner radius $r_1$ of scoring roller aperture 312 is made slightly smaller than the corresponding radius $r_2$ of shaft 392 so as to provide a friction fit. Accordingly, when portions 399 and 307 of scoring roller 300 are fitted around shaft 392 and connecting bolts 346 are tightened, the roller is securely connected to the shaft 392. In addition to enabling a non-slip fit between scoring roller 300 and shaft 392, such split contruction of the scoring rollers enables installation of the rollers onto the respective shafts without the necessity for removing the shafts from folding machine.

Referring concurrently to FIGS. 4 and 5, there are shown a side view and a cross-sectional view, respectively, of a web scoring apparatus 400. This apparatus includes first and second web scoring or perforating members 496 and 498, respectively. Each of these members is referred to as a scoring roller but can provide a scoring or perforating function depending upon the blade utilized therewith (see FIG. 3). Preferably, scoring rollers 496 and 498 are constructed in an identical manner except, possibly, for the blade used. Accordingly, only scoring roller 496 is described in detail.

To enable easy and rapid mounting and removal thereof, scoring roller 496 is split in half across the diameter thereof. As shown in FIG. 3, the roller is formed of semi-circular web scoring (i.e. blade) portion 401 and a corresponding, resilient roller (i.e. pad) or blade abutment portion 402. The details of the roller construction are shown in FIG. 3.

The operating stage 400 includes a pair of the scorer rollers arranged to produce a continuous operation on the web 430. Scoring rollers 482 and 488 are mounted on respective shafts 492 and 496 so that blades 406 (or 456) are in a common plane passing through and perpendicular to fold and scoring line 84 (see FIGS. 1 and 2). The blades are mounted to support elements by means of screws 382. The several flanges are also shown. The blade edge 414 (or 456) of blade portions 406 (or 456) of each roller rolls along resilient roller strip 442 of the other scoring roller. The roller strips 442 are mounted in the grooves 443 (see FIG. 5). Diameter $D_1$ of the scoring rollers 482 and 488 and the separation between mounting shafts 492 and 496 are, of course, arranged such that the scoring rollers are in peripheral rolling contact with one another during a scoring operation.

It can be appreciated that as web 430 advances between rotating scoring rollers 482 and 488, the web is scored in alternate directions along line 84 (see FIG. 1). That is, the web is scored in one direction by blade 456 of scorer roller 482 and in the opposite direction by the blade 455 of scorer roller 488.

For web 130 to be scored correctly for subsequent sheet folding in a second folding stage, the length of the score line along line 84, in each direction, should be equal to the length of the second stage fold. Also, for proper web scoring, to avoid slippage between the web and scoring rollers, as well as misscoring and tearing of the web, the arc length of blades and resilient strips should be substantially equal to the length of the second stage fold. Normally, however, the blade edge radius $R_1$ is slightly greater than radius $R_4$ of resilient strip 342 in order to enable the blade indentation of the strips. Thus, the arc length of blade edge is slightly greater than the second stage fold line. However, for purposes of describing and claiming the present invention, the arc length of the blade portions are considered to be equal to the second stage fold line, as is practically the case.

Typically, scoring rollers 482 and 488 are each about 7.32 inches in diameter. The diameter of scoring roller mounting aperture 312 is, typically, about 2.5 inches and is a few thousandths smaller than the outside diameter of shafts 492 and 496 at the roller attachment positions. Inner radius $r_1$ of blade 356 (or 396) is about 1.5 inches. The combined thickness of flange 336 and strip 342 is about 0.63 inch. Nominal thickness of blade edge 394 (or 364) is between about 0.03 inches and 0.06 inches. Other than blade 396 (or 356) and resilient strip 342, scoring rollers 482 and 488 may be constructed of steel, such as tool steel or knife blade steel.

Roller shafts 492 and 494, on which scoring rollers 496 and 498 are mounted, are connected to gears or any other conventional drive train (not shown). The drive train causes the shafts to be rotated opposite directions.

Referring now to FIG. 6, there is shown a partial, cross-sectional view of the interaction of a blade 396 with a resilient pad 342. Because the blade edge radius $R_1$ (see FIG. 3) of blade 396 (or blade 356) is slightly greater than radius $R_4$ of the resilient roller, blade edge 394 (or 364) causes a slight indentation 601 several thousandths of an inch deep into the abutting resilient roller strip 342. Thus, when web 130 is advanced between rotating rollers 496 and 498, blade edge 394 pushes the web into resilient strip 342. A grooved indentation or score 348 is thereby caused in the web along line 84.

Referring now to FIGS. 7 and 8, there are shown representative arrangements of the resilient pad in the scoring roller. In particular, in FIG. 7, there is shown an end of the roller portion with flange 336 (see FIG. 3). A T-shaped, resilient pad 342 is shown. The inner end of pad 342 is wider than the outer end and is secured in groove 443. This pad has the outer end thereof substantially flush with the outer surface of the flange 336. This arrangement is the preferred embodiment.

In FIG. 8, there is shown an alternative embodiment. In this embodiment, the pad 842 is I-shaped. One cross-member is entrapped in the slot in flange 336 while the other cross-member protrudes slightly above the surface of the flange. This configuration can be used, if desired. Of course, other configurations of the resilient pad are also contemplated.

It should further be appreciated that blade portions and resilient roller portions need not necessarily each be semicircular. For example, if the outer diameter $D_1$ of rollers 496 and 498 (see FIGS. 4 and 5) are twice the diameter of the print rollers in the press and the roller mounting shafts are rotated at half the rate of the printing rollers, each scoring roller 300 (see FIG. 3) could be constructed of alternating 90° blade and roller portions. The only requirement is that the arc length of blade and roller portions be equal in length to the second stage fold.

Some signature folding machines could be constructed having two series-arranged, folding stages such that two transverse folds are made before a longitudinal fold is made. From the above description, it is apparent that the sheets would then require that four, instead of two, alternately directed scores be made by apparatus 300, prior to second stage folding. In such case, for the same size scoring rollers 356 and 396, alternating 90° blade and roller portions would be provided on each roller. Again, it is required that the arc length of blade and roller portions be equal to the length of the "second" stage fold.

Although a specific arrangement of a prefold, web scoring apparatus for use in printing systems and corresponding web scoring methods in accordance with the invention is described for purposes of illustrating the manner in which the invention may be used to advantage, it is to be appreciated that the invention is not limited thereto. Accordingly, any and all modifications, variations or equivalent arrangements which may occur to those skilled in the art should be considered to be within the scope of the invention as defined in the appended claims.

We claim:

1. An improved web scoring apparatus comprising, a first arcuate blade support element having a flat surface and an arcuate peripheral surface, a first arcuate pad support element having a flat surface and an arcuate peripheral surface, said first blade support element and said first pad support element arranged to be joined together at the respective flat surfaces so that the respective arcuate peripheral surfaces form a continuous arcuate surface, first arcuate blade means detachably mounted to said first blade support element, first resilient pad means detachably mounted at the peripheral surface of said first pad support element, said first pad support element includes a groove in the peripheral surface thereof to receive said first resilient pad means, said groove includes an enlarged inner end to secure said first resilient pad means, said first resilient pad means includes an enlarged inner end which is detachably secured in said groove, a second arcuate blade support element having a flat surface and an arcuate peripheral surface, a second arcuate pad support element having a flat surface and an arcuate peripheral surface, said second blade support element and said second pad support element arranged to be joined together at the respective flat surfaces so that the respective arcuate peripheral surfaces form a continuous arcuate surface which is mounted adjacent to the continuous arcuate surface of said first arcuate blade support element and said first arcuate pad support element, second arcuate blade means detachably mounted to said second blade support element, and second resilient pad means detachably mounted at the peripheral surface of said second pad support element, said second pad support element includes a groove in the peripheral surface thereof to receive said second resilient pad means, said groove includes an enlarged inner end to secure said resilient pad means, said second resilient pad means includes an enlarged inner end which is detachably secured in said groove,

2. The apparatus recited in claim 1 wherein, said arcuate blade comprises a scoring blade and said second arcuate blade comprises a perforating blade.

3. The apparatus recited in claim 1 wherein, at least one of said first and second arcuate blade means comprises a scoring blade which has a continuous, relatively narrow edge.

4. The apparatus recited in claim 1 wherein, at least one of said first and second arcuate blade means comprises a perforating blade which has a toothed, relatively narrow edge.

5. The apparatus recited in claim 3 wherein, said scoring blade has an arcuate dimension of approximately 180°.

6. The apparatus recited in claim 1 wherein, said first arcuate blade means engages said second resilient pad means and said second arcuate blade means engages said first resilient pad means, respectively.

7. The apparatus recited in claim 1 wherein, each of said resilient pad means is mounted to said pad support means such that the peripheral surface of said resilient pad means is substantially flush with the surface of said pad support means.

8. The apparatus recited in claim 1 wherein, each of said first and second arcuate blade support elements is mounted on a separate roller shaft along with the first and second arcuate pad support element which is joined thereto.

9. The apparatus recited in claim 8 wherein, said separate roller shafts are adapted to rotate in the opposite direction from each other and to drive the respective roller means in the opposite direction.

10. The apparatus recited in claim 1 wherein, each of said pad support element is approximately twice as wide as said blade support element.

11. The apparatus recited in claim 10 wherein, said resilient pad means is approximately one half as wide as said pad support element and is positioned at approximately the mid-point of said peripheral surface of said pad support element.

12. The apparatus recited in claim 1 wherein, said arcuate blade means is mounted to said blade support element by bolt means.

13. The apparatus recited in claim 1 wherein, each of said arcuate blae means extends radially beyond said blade support element.

14. Roller means comprising, first and second semi-circular mounting members, said first and second mounting means each having a semi-circular opening extending radially outwardly from the radial center thereof, center flange means extending axially outwardly from each of said first and second mounting means and disposed around said openings therein, semi-circular blade means detachably mounted to said first mounting means around the center flange means thereof, said blade means mounted on said first mounting means is substantially aligned with the center of said groove means formed in said second mounting means whereby said blade means is adapted to abut said resilient pad means mounted within said groove means, peripheral flange means extending axially outwardly from said second mounting means and disposed along the outer periphery thereof, groove means formed in the outer surface of said peripheral flange means, said groove means is substantially inverted T-shaped with the cross bar thereof internally disposed within said peripheral flange, T-shaped resilient pad means detachably mounted within said groove means in said second mounting means, and connecting means for selectively connecting said first and second mounting means together to form one central opening and a continuous center flange around said central opening.

* * * * *